US005135178A

United States Patent [19]

Strohmeyer

[11] Patent Number: 5,135,178

[45] Date of Patent: Aug. 4, 1992

[54] KNIFE SHAFT ASSEMBLY FOR DOCUMENT SHREDDERS

[75] Inventor: Willi Strohmeyer, Hanover, Fed. Rep. of Germany

[73] Assignee: PBS-Servicegesellschaft mbH & Co. KG, Hanover, Fed. Rep. of Germany

[21] Appl. No.: 658,852

[22] Filed: Feb. 22, 1991

[30] Foreign Application Priority Data

Feb. 22, 1990 [DE] Fed. Rep. of Germany ..... 4005556

[51] Int. Cl.[5] ..... B02C 18/16

[52] U.S. Cl. ..... 241/295; 83/501; 241/236

[58] Field of Search ..... 83/664, 500, 501; 241/236, 235, 242, 243, 234, 255, 293, 286, 230, DIG. 30

[56] References Cited

U.S. PATENT DOCUMENTS

| | | | |
|---|---|---|---|
| 737,194 | 8/1903 | Armstrong | 83/664 |
| 2,589,603 | 3/1952 | Cohen | 241/DIG. 30 X |
| 2,804,134 | 8/1957 | Berry et al. | 83/501 |

FOREIGN PATENT DOCUMENTS

| | | | |
|---|---|---|---|
| 3616554 | 11/1987 | Fed. Rep. of Germany . | |
| 454623 | 9/1936 | United Kingdom | 83/501 |
| 1022409 | 3/1966 | United Kingdom . | |

*Primary Examiner*—Mark Rosenbaum
*Assistant Examiner*—Willmon Fridie, Jr.
*Attorney, Agent, or Firm*—Foley & Lardner

[57] ABSTRACT

A knife shaft assembly (1) for a document shredder formed from a series of cutting disks (3) arranged on a shaft (2) with spacer rings (4) disposed between them. The spacer rings (4) are compressible, and a securing mechanism, such as snap rings (6) received in grooves (5), is provided on the shaft to secure the cutting disks (3) on the shaft (2) under compression. During assembly, the spaces between the cutting disks (3) are adjusted to a predetermined size by compression in the axial direction. This arrangement enables material costs to be kept low while assuring high dimensional accuracy of the knife shaft assembly.

5 Claims, 2 Drawing Sheets

KNIFE SHAFT ASSEMBLY FOR DOCUMENT SHREDDERS

BACKGROUND OF THE INVENTION

This invention relates to a knife shaft assembly for a document shredder, which is formed by a plurality of cutting disks arranged on a shaft with spacer rings between them.

Document shredders have as a rule two knife shaft assemblies whose cutting disks intermesh in contact with one another and which are driven to rotate in opposite directions. Documents fed in between the cutting disks are shredded. If the cutting disks are thin and contact one another on only one side where they cut the paper, it is important for trouble free operation that the disks be held tightly against one another and that the spacing of the cutting disks arranged on the knife shafts and held tightly against one another be the same on both knife shaft assemblies. Otherwise stresses occur between the two knife shaft assemblies resulting in increased friction, lowering the output of the document shredder, and making it impossible to assemble an effective cutting mechanism. On the other hand, dimensional variations may cause the cutting disks to fail to contact one another, so that no cutting occurs.

Any variations in the spacing between the cutting disks on the knife shafts can also lead to problems if one piece strippers are used with fixed spacing between the fingers as described, for example, in German Published Patent Application No. DE 36 16 554. In such a case, if there are dimensional differences between the cutting disks and the stripper, harmful friction will result, and in some cases it may even be impossible to assemble the cutting mechanism.

Inaccuracies in the knife shaft assemblies of the kind described can very easily result if the cutting disks are stamped and then ground from a material of slightly varying thickness. The same applies to the spacer rings which are usually made by turning. Over the length of the knife shaft assemblies, slight differences in the material thickness can be so great that the adverse effect described above can very easily occur. To prevent such undesirable inaccuracies it has heretofore been necessary to engage in a great deal of trouble and expense in selecting the material and in manufacturing the components.

SUMMARY OF THE INVENTION

It is the object of this invention to avoid the foregoing disadvantages and provide knife shaft assemblies having accurate dimensions at reasonable cost.

These and other objects of the invention are achieved by providing a knife shaft assembly for a document shredder comprising a series of cutting disks arranged on a shaft with spacer rings disposed between them and means disposed on said shaft for securing said cutting disks and spacer rings thereon, wherein said spacer rings are formed of a compressible material, such that the intervals between the cutting disks can be adjusted to a predetermined size by compressing the spacer rings in the axial direction of the shaft.

Inasmuch as the spacer rings of the knife shaft assembly are made compressible, and means are disposed on the shaft to secure the cutting disks and spacer rings on the shaft such that the spacing between the cutting disks can be adjusted to a predetermined desired width by compression in the axial direction, it is possible to produce knife shaft assemblies having the correct dimensions with great precision.

It has been found that spacer rings manufactured from a deformable plastic can be used. Such spacer rings can be manufactured economically by injection molding and are particularly suitable for use in smaller document shredders where the knife shaft assemblies are subject to relatively low stress during the shredding process. For the knife shaft assemblies of larger, high output document shredders, it has proven advantageous to make the spacer rings from a high strength material, such as even a metal that is deformable. In this way the spacer rings can be protected against being deformed by the higher cutting forces encountered at the cutting disks.

It has proven advantageous for the spacer rings to be conically configured or beveled on at least one axial end face, and preferably on both axial end faces. If the greatest axial width of the spacer rings is adjacent their outer circumferential edge, the deformation will occur only in the radially outer region of the spacer rings. The material will then be displaced radially outwardly when the rings are compressed, rather than inwardly against the shaft, thus assuring that the freedom of the spacer rings to shift along the surface of the knife shaft will not be impaired. Then, when the rings and cutting disks are compressed together lengthwise of the shaft, displaced ring material will not be able to cause additional friction against the shaft which might require greater force to deform the rings. If the circumferential surfaces of the spacer rings are spherically rounded, it will be possible to prevent the displaced material from increasing the outside diameter of the spacer rings. The material displaced by the compression will accumulate instead at the circumference of the spacer rings in the portions adjacent the areas of deformation. The sphericity is preferably selected such that the bulge produced by compression in the sections adjacent the areas of deformation will not exceed the maximum diameter of the spacer rings in the area of greatest rounding.

The means for securing the cutting disks and spacer rings of the knife shaft assemblies preferably take the form of grooves arranged at both ends of the shaft and engaged by snap rings. In this case the grooves provided in the shaft establish precisely the length of the knife assembly. When the knife shaft assembly is assembled, the procedure is to string the cutting disks and spacer rings on the shaft, push a snap ring into the groove at one end, and then with the aid of a tool, compress the cutting disks and the spacer rings together to the predetermined length, so that the snap ring can be pushed into the groove at the opposite end of the knife shaft in order to secure the cutting disks and the spacer rings in the correct position.

BRIEF DESCRIPTION OF THE DRAWINGS

The invention will be explained in further detail hereinafter with reference to illustrative preferred embodiments shown in the accompanying drawings in which.

DETAILED DESCRIPTION OF PREFERRED EMBODIMENTS

Figure 1:
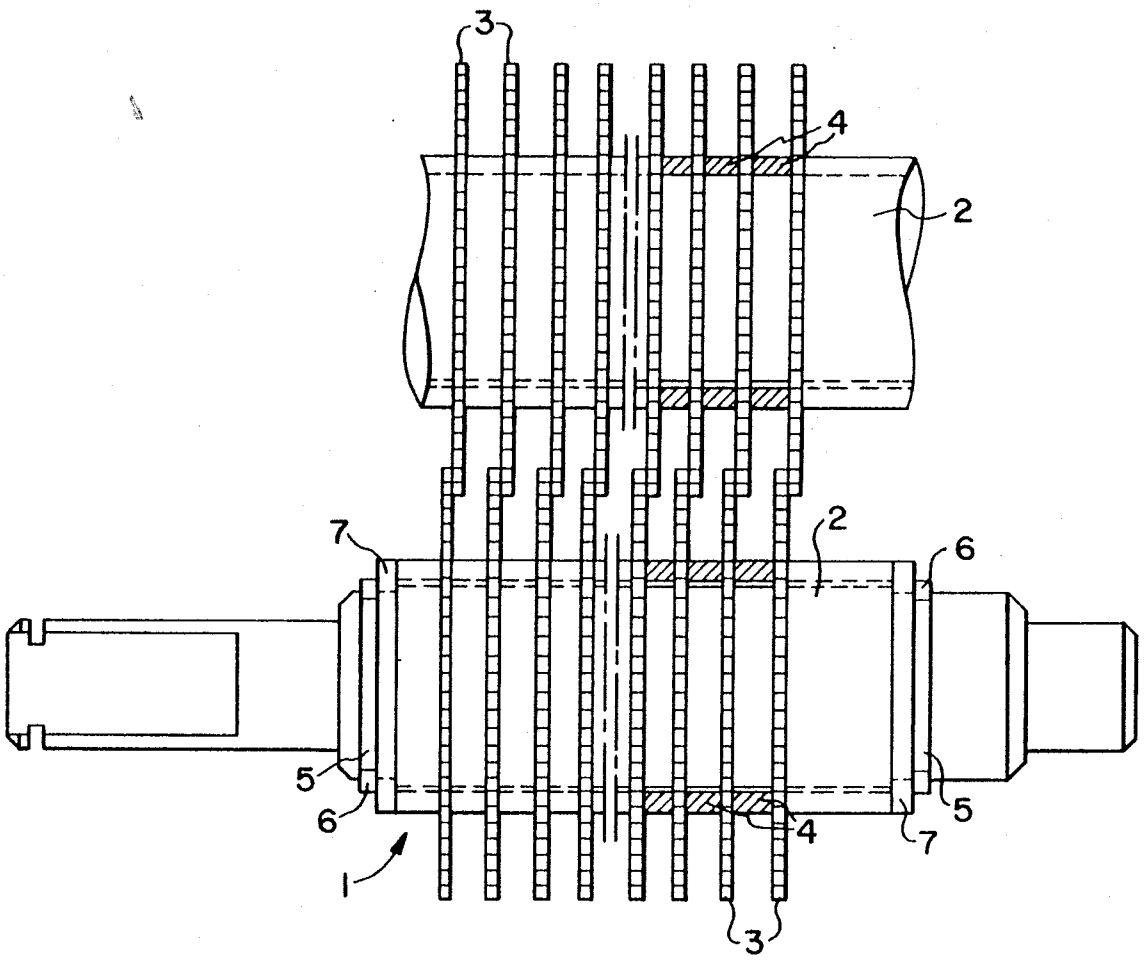
FIG. 1 is a side view of a knife shaft assembly of a document shredder.

FIG. 1 shows a knife shaft assembly 1 comprising a shaft 2 on which cutting disks 3 and spacer rings 4 are arranged in sequence. In the shaft 2, grooves 5 are disposed on both sides of the series of cutting disks 3 and spacer rings 4, and snap rings 6 are inserted into the grooves 5. Intermediate rings 7 are disposed on the shaft 2 in contact with the snap rings 6. Through the intermediate rings 7 the snap rings 6 hold the cutting disks 3 and spacer rings 4 in their position in which they are urged against one another during assembly by means of a tool, not shown in the drawing. The provision of the intermediate rings 7 serves in this case merely for an optimum transfer of the compression forces to the snap rings 6. It is quite possible to omit the intermediate rings 7, if desired.

Figure 2:
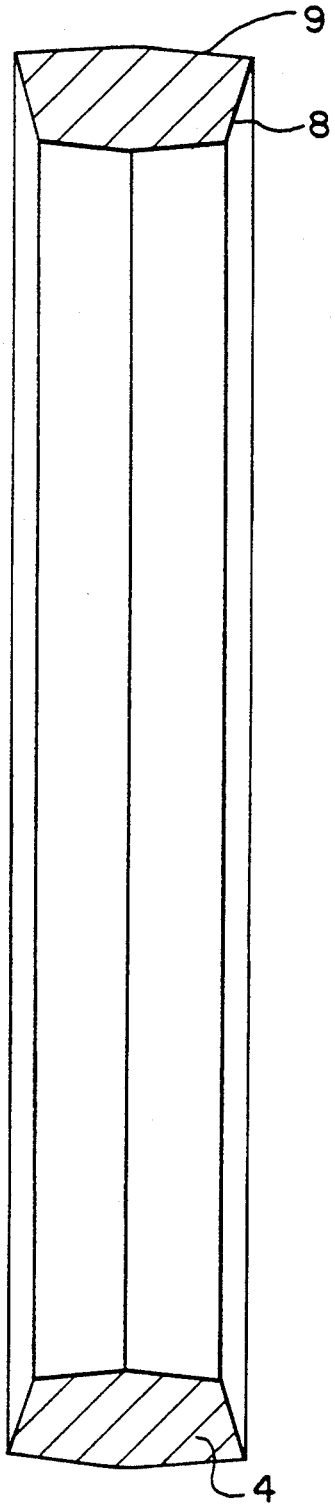
FIG. 2 is a cross-sectional view of a spacer ring.

FIG. 2 shows a cross-sectional view of a spacer ring 4. As can be seen in the drawing, both axial end faces 8 of the spacer ring 4 are conically configured or beveled. This causes the adjacent spacer rings to have small areas of contact at which great pressures per unit area will be produced upon compression. This produces the advantage that, in the initial phase of the compression, a relatively great deformation can be achieved by means of a relatively low force. As deformation increases, the surfaces in contact increase in size, so that finally, after reaching the predetermined size, a desired stiffening of the knife shaft assembly 1 is achieved. This means that the desired deformation of the spacer rings 4 will be achieved during assembly without great difficulty, but that the knife shaft assembly 1 will be sufficiently stable in the fully assembled state to meet the conditions in which it will be used. It is possible by selecting the degree of bevel on the sides 8 of the spacer rings 4 and by selecting the material used to form the spacer rings, to adapt the spacer rings 4 to the conditions required in each case. For a small shredder, it has been found desirable to make the spacer rings 4 for the knife shaft assembly 1 from a suitable plastic. For knife shaft assemblies 1 subject to heavy loads, it has been found desirable to manufacture the spacer rings 4 from a deformable metal. The selection of a suitable material is governed by the amount of stress on the spacer rings 4 and the configuration of the axial end faces 8 of the spacer rings 4. It has been found especially advantageous for the axial end faces 8 to be inclined at an angle of about 15°.

Advantageously, the spacer rings 4 are rounded spherically on their circumferential surfaces 9. As a result, when the spacer rings are deformed at the contacting surfaces, the circumferential areas 9 that bulge out in the vicinity of the contacting surfaces will not increase the outside diameter of the spacer rings 4. The spherical curvature of the circumferential surfaces 9 of the spacer rings is preferably selected such that the bulging of the circumferential surfaces 9 will not exceed the greatest diameter in the center of the circumferential surfaces 9.

If the spacer rings 4 are made of plastic, it is possible, for example, to injection mold the spacer rings 4 from polyethylene. Spacer rings 4 subject to greater stresses can be made, for example, from brass alloys. It is also possible, of course, to use other deformable materials.

The knife shaft unit 1 of the invention is assembled by sliding the cutting disks 3 and the spacer rings 4 onto the shaft 2. After placing a snap ring 6 in a groove 5 of the shaft 2, the cutting disks 3 and the spacer rings 4 are compressed together by means of a tool, not shown in the drawing, to such an extent that a second snap ring 6 can be inserted into the groove 5 at the free end of the shaft 2. The spacing between the grooves 5 determines the correct length of the knife shaft assembly 1. After the tool is removed, the snap rings 6 hold the cutting disks 3 and the spacer rings 4 compressed together.

Due to the deformability of the spacer rings 4, not only is the correct total length of the knife shaft assembly 1 achieved in the compressed state, but also the correct spacing between the individual cutting disks 3. Thus great accuracy in the dimensions of the knife shaft assembly 1 is assured regardless of variations in the material thicknesses of the individual cutting disks 3. This means that the cutting disks 3 of the two knife shaft assemblies 1, which intermesh with one another when the document shredder is in the assembled state, will always be at the correct distance from one another. The cutting disks 3 contact one another such that a perfect cutting action is assured, but on the other hand the friction between the cutting disks 3 is so slight that the performance of the document shredder is not impaired.

If a stripper made in one piece is used, a sufficient clearance between the cutting disks 3 and the fingers of the stripper is thus assured, so that here, again, no harmful friction can be produced. The knife shaft assembly 1 of the invention assures that high performance document shredders can be manufactured with uniformly high quality at lower cost.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A knife shaft assembly for a document shredder comprising a series of cutting disks arranged on a shaft with spacer rings disposed between them and means disposed on said shaft for securing said cutting disks and spacer rings thereon, wherein said spacer rings are formed of a compressible material, such that the intervals between the cutting disks can be adjusted to a predetermined size by compressing the spacer rings in the axial direction of the shaft; said spacer rings are beveled to have a concave conical configuration on both axial end faces, and the greatest axial width of said the spacer rings is adjacent the outer circumference.

2. A knife shaft assembly according to claim 1, wherein said mans for securing said cutting disks and said spacer rings on said shaft comprise grooves formed in said shaft and snap rings received in said grooves.

3. A knife shaft assembly according to claim 1, wherein the spacer rings (4) are beveled at an angle of approximately 15°.

4. A knife shaft assembly according to claim 1, wherein said spacer rings have a spherical configuration at their circumferential surfaces.

5. A knife shaft assembly according to claim 1, wherein said means for securing said cutting disks and spacer rings comprise grooves disposed in said shaft at both ends into which snap rings engage.

* * * * *